US007303523B2

(12) United States Patent
Andolfi

(10) Patent No.: US 7,303,523 B2
(45) Date of Patent: Dec. 4, 2007

(54) PAPER-FOLDING APPARATUS

(76) Inventor: Ceasar P. Andolfi, 5025 Dakota Ter., North Port, FL (US) 34286

( * ) Notice: Subject to any disclaimer, the term of this patent is extended or adjusted under 35 U.S.C. 154(b) by 209 days.

(21) Appl. No.: 10/924,610

(22) Filed: Aug. 24, 2004

(65) Prior Publication Data

US 2005/0049131 A1 Mar. 3, 2005

Related U.S. Application Data

(60) Provisional application No. 60/498,332, filed on Aug. 26, 2003.

(51) Int. Cl.
*B31F 1/10* (2006.01)

(52) U.S. Cl. ..... 493/434; 493/405; 493/415; 493/424; 493/442; 271/10; 271/93; 271/99; 271/107

(58) Field of Classification Search ..... 271/10–12, 271/93, 94, 95, 99, 102, 107, 112, 115, 131–133, 271/137, 139; 493/405, 415, 424, 434, 442
See application file for complete search history.

(56) References Cited

U.S. PATENT DOCUMENTS

| | | | | |
|---|---|---|---|---|
| 3,297,315 A | | 1/1967 | Kunz | 270/86 |
| 3,510,122 A | * | 5/1970 | Gavaghan | 493/421 |
| 3,568,401 A | | 3/1971 | Bonsch | |
| 3,729,186 A | | 4/1973 | Macke | 270/68 A |
| 3,960,373 A | * | 6/1976 | Pacholok | 271/10.14 |
| 4,042,148 A | * | 8/1977 | Gerben | 221/222 |
| 4,043,859 A | * | 8/1977 | Van Dam et al. | 156/566 |
| 4,190,242 A | | 2/1980 | Bolza-Schunemann | 270/50 |
| 4,221,373 A | | 9/1980 | Muller Hans | 270/86 |
| 4,243,215 A | | 1/1981 | Van den Bergh | 493/422 |
| 4,358,285 A | | 11/1982 | Fujino | 493/411 |
| 4,369,961 A | * | 1/1983 | Gopel et al. | 271/35 |
| 4,480,422 A | | 11/1984 | Meives et al. | 53/207 |
| 4,508,529 A | | 4/1985 | Feldkamper | 493/438 |
| 4,619,101 A | | 10/1986 | Havey, Jr. et al. | 53/117 |
| 4,661,091 A | | 4/1987 | Moen | 493/417 |
| 4,712,359 A | | 12/1987 | DePasquale et al. | 53/460 |

(Continued)

FOREIGN PATENT DOCUMENTS

EP 0 375 146 6/1990

(Continued)

*Primary Examiner*—Hemant M. Desai
(74) *Attorney, Agent, or Firm*—Gifford, Krass, Sprinkle, Anderson & Anderson, P.C.

(57) ABSTRACT

A paper-folding apparatus includes a hopper for holding one or more sheets of paper or other similar foldable media, a discharge feed and stripper assembly, a shuttle associated with the hopper operable to transfer a sheet of paper from the hopper to the discharge feed and stripper assembly, a conveyor that receives one or more sheets of paper from the discharge feed and stripper assembly, and a folding roller assembly that receives the one or more sheets of paper from the conveyor, folds, and then ejects the folded paper(s) from the paper-folding apparatus. A driver assembly including a motor and an arrangement of clutches is provided and is operable to actuate the shuttle, discharge feed and stripper assembly, conveyor, and folding roller assembly. A control panel is also provided to permit a user to manage and otherwise operate the paper-folding apparatus in an efficient manner.

25 Claims, 3 Drawing Sheets

U.S. PATENT DOCUMENTS

| | | | | | |
|---|---|---|---|---|---|
| 4,781,013 | A | | 11/1988 | DePasquale et al. | 53/569 |
| 4,805,382 | A | | 2/1989 | DePasquale et al. | 53/520 |
| 4,805,384 | A | | 2/1989 | DePasquale et al. | 53/569 |
| 4,817,368 | A | | 4/1989 | DePasquale et al. | 53/460 |
| 4,944,131 | A | * | 7/1990 | Gough | 53/117 |
| 5,031,889 | A | | 7/1991 | Raker et al. | 270/45 |
| 5,037,365 | A | | 8/1991 | Breton | 493/18 |
| 5,139,248 | A | | 8/1992 | Kishine et al. | 270/39 |
| 5,330,171 | A | * | 7/1994 | Murad et al. | 271/131 |
| 5,374,233 | A | | 12/1994 | Lehmann et al. | 493/421 |
| 5,409,205 | A | * | 4/1995 | Macke et al. | 271/133 |
| 5,425,533 | A | | 6/1995 | Dronsfield | 271/9 |
| 5,464,203 | A | * | 11/1995 | Bowser et al. | 271/12 |
| 5,732,941 | A | | 3/1998 | Moll | 271/10.07 |
| 5,803,891 | A | | 9/1998 | Haan et al. | 493/442 |
| 5,888,047 | A | * | 3/1999 | Auerbach et al. | 414/797.8 |
| 6,132,554 | A | | 10/2000 | Traise et al. | 156/442.1 |
| 6,142,288 | A | | 11/2000 | Hotkowski et al. | 198/409 |
| 6,251,055 | B1 | * | 6/2001 | Evers et al. | 493/419 |
| 6,554,271 | B1 | | 4/2003 | Lindsay et al. | 271/121 |
| 6,824,010 | B1 | * | 11/2004 | Erikawa | 221/221 |

FOREIGN PATENT DOCUMENTS

| | | | |
|---|---|---|---|
| JP | 57174284 | A | 10/1982 |
| JP | 06247566 | A | 9/1994 |

* cited by examiner 10
12
14
18
20
22
24
28
30
36
38
40
42
44
46
48
52
56
60
78
84
92
93
95
97
106
108
110
112
114
116
118
120
122
126
128
131
136
138
140
142
144
146
148
150
152
154
156
158
162
170
172
174
176
178
180
182

PAPER-FOLDING APPARATUS

REFERENCE TO RELATED APPLICATION

This application claims benefit from U.S. provisional patent application Ser. No. 60/498,332, filed Aug. 26, 2003, which is incorporated herein in its entirety by reference.

FIELD OF THE INVENTION

The present invention is directed to an apparatus for folding paper. More specifically, the invention is directed to a paper-folding apparatus that is operable to fold one or more sheets (i.e., a stack) of paper (or other foldable media) at a time. The apparatus has a drive assembly that may include a single motor and an arrangement of clutches that are operable to selectively actuate various components of the apparatus.

REFERENCE TO RELATED ART

Paper-folding machines are often used in connection with envelope-stuffing devices to prepare letters for bulk mailing. Paper-folding machines also have utility in the preparation of folded brochures, bookbinding and folding programs for events.

An early version of a folding apparatus is shown in U.S. Pat. No. 3,297,315 to Kunz. The Kunz reference discloses a folding machine having an array of rollers between which is positioned a stack of paper. A series of guide rods are used to fold the stack of paper into a desired orientation. The Kunz machine is powered by a drive motor that has an infinitely variable speed transmission. However, it is clear that the drive motor continuously drives all of the components of the Kunz machine.

In addition to the envelope-stuffing apparatus mentioned above (see also, U.S. Pat. No. 4,712,359 to DePasquale et al. and the divisional applications therefor), there are also machines that operate to control the feeding or delivery of paper into a folding apparatus. For example, U.S. Pat. No. 5,732,941 to Moll shows a device for feeding individual sheets of paper into a paper folder. Specifically, the Moll device can feed a sheet of paper from the bottom of a stack of papers onto a conveyor for transport to a folding apparatus. According to Moll, the ability to remove sheets from the bottom of a stack allows a user to easily add additional papers to the top of the stack without stopping or slowing the folding operation.

One particular disadvantage of prior art paper-folding machines is their size. Typically, folding machines are large, complicated in design and difficult to operate and maintain. Indeed, despite the growing need for folding machines, the inherent disadvantages mean that ownership of such devices is generally limited to commercial printers, copier services and large corporations. Therefore, it would be advantageous to have a folding apparatus of simplified design and convenient size.

SUMMARY OF THE INVENTION

A paper-folding apparatus includes a hopper for holding one or more sheets of paper or other similar foldable media (not shown, but may include paper, transparencies, vellum, parchment, linen, etc.), a discharge feed and stripper assembly, a shuttle associated with the hopper operable to transfer a sheet of paper from the hopper to the discharge feed and stripper assembly, a conveyor that receives one or more sheets of paper from the discharge feed and stripper assembly, and a folding roller assembly that receives the one or more sheets of paper from the conveyor, folds, and then ejects the folded paper(s) from the paper-folding apparatus. A driver assembly is provided that is operable to actuate the shuttle, discharge feed and stripper assembly, conveyor, and folding roller assembly. A control panel is also provided to permit a user (with the assistance of control software (as is known in the art)) to manage and otherwise operate the paper-folding apparatus in an efficient manner.

BRIEF DESCRIPTION OF THE DRAWINGS

A better understanding of the present invention will be had upon reference to the attached drawings wherein like reference numerals refer to like parts throughout and wherein.

DETAILED DESCRIPTION OF THE INVENTION

Figure 1:
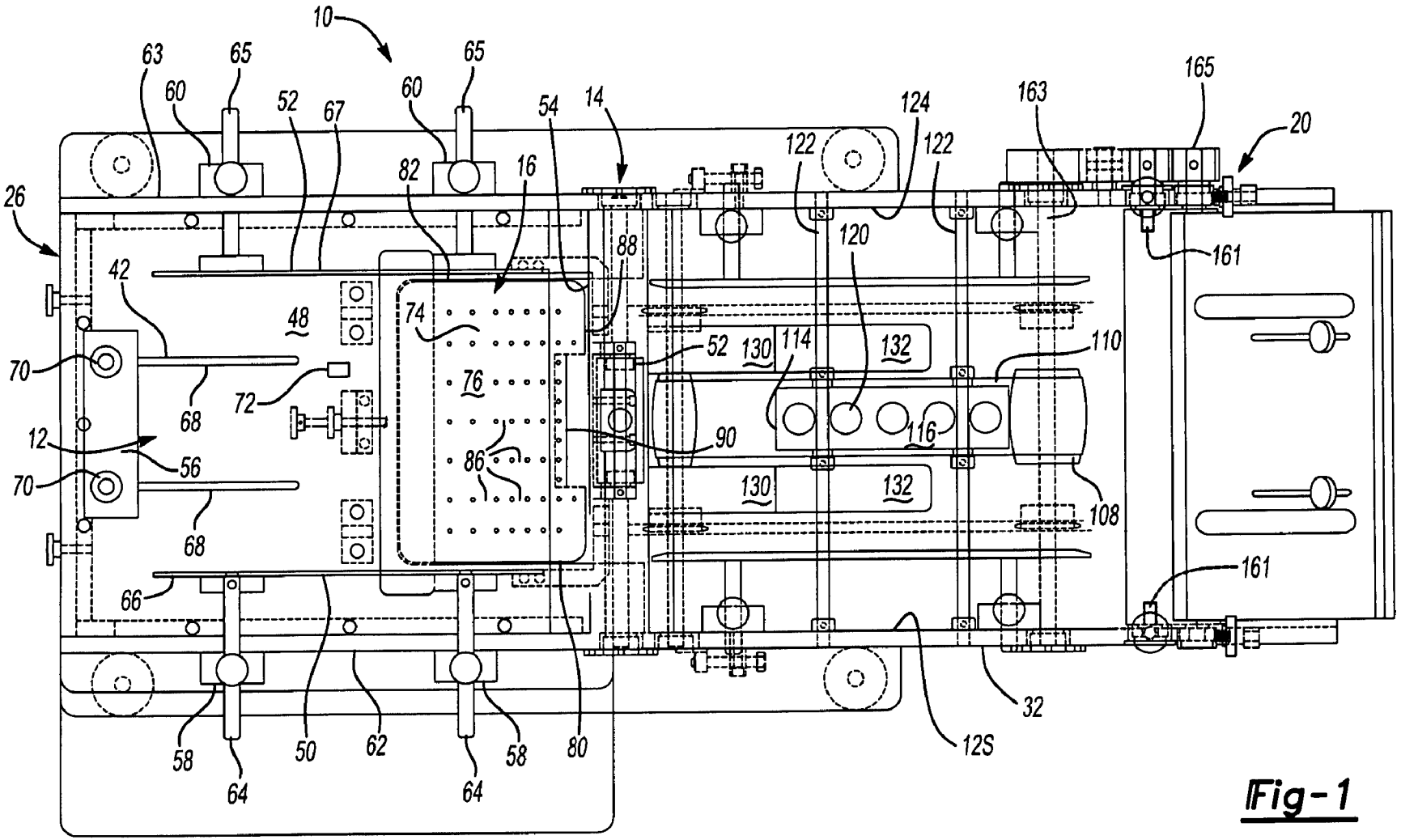
FIG. 1 is a top planar view of a paper-folding apparatus constructed in accordance with the present invention.
Figures 2A, 2B:
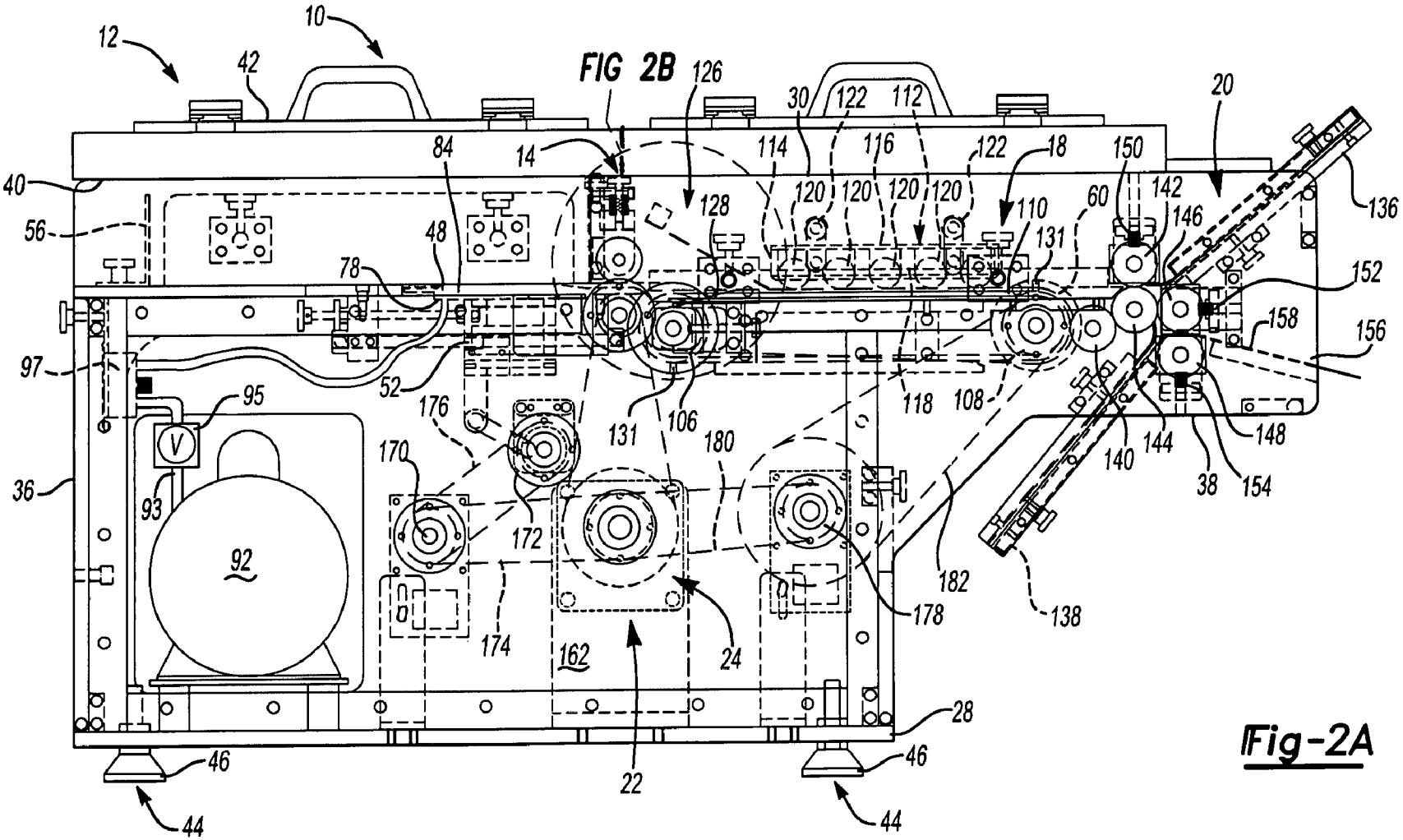
FIG. 2A is a side planar view of the paper-folding apparatus of FIG. 1.
FIG. 2B is an enlarged side planar of a portion of the paper-folding apparatus shown in FIG. 2A.
Figure 2B:
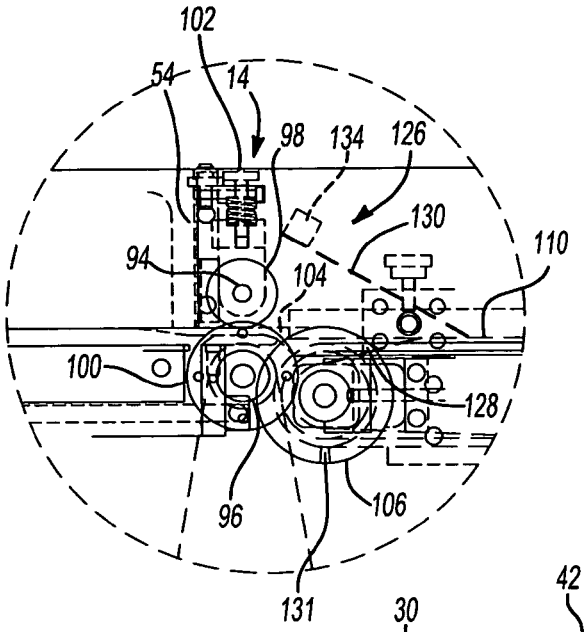

Referring now to FIGS. 1 and 2, a paper-folding apparatus 10 includes a hopper 12 for holding one or more sheets of paper or other suitable foldable media (not shown, but may include paper, transparencies, vellum, parchment, linen, photographs, etc.), a discharge feed and stripper assembly 14, a shuttle 16 associated with the hopper operable to transfer a sheet of paper from the hopper 12 to the discharge feed and stripper assembly 14, a conveyor 18 that receives one or more sheets of paper from the discharge feed and stripper assembly 14, and a folding roller assembly 20 that receives the one or more sheets of paper from the conveyor 18, folds, and then ejects the folded paper(s) from the paper-folding apparatus 10. A driver assembly 22 is provided that is operable to actuate the shuttle 16, discharge feed and stripper assembly 14, conveyor 18, and folding roller assembly 20. A control panel 24 is also provided to permit a user (with the assistance of control software (as is known in the art)) to manage and otherwise operate the paper-folding apparatus 10 in an efficient manner.

Figure 3:
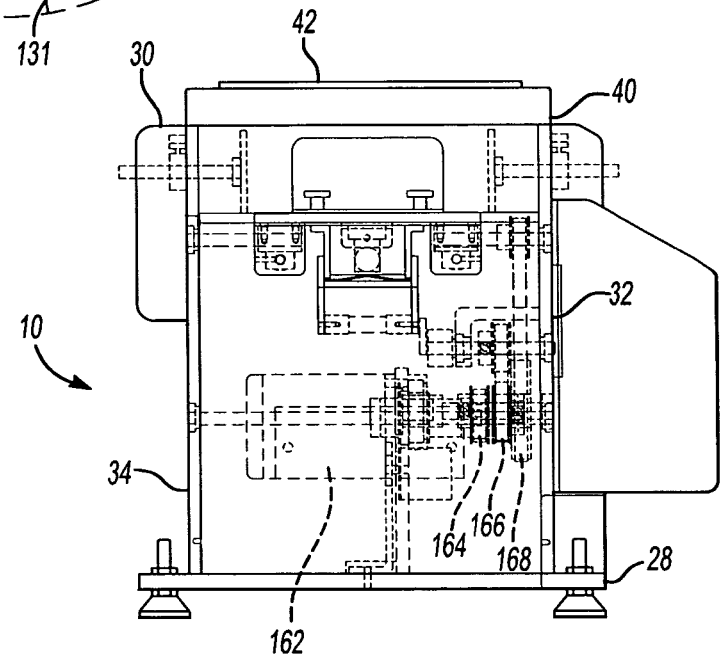
FIG. 3 is an end view of the paper-folding apparatus shown in FIG. 1, taken from the left side and view of the apparatus of FIG. 1.

Referring now to FIGS. 1-3, the paper-folding apparatus 10 has a body 26 including a base 28, an upper surface 30, a front wall 32, a rear wall 34, a first end wall 36 and a second end wall 38. It will be appreciated that the surface 30 and walls 32, 34, 36, 38 may be constructed of an underlying framework on which are mounted one or more exterior body panels. As will be described below, the upper surface 30 defines an opening 40 proximate the hopper 12 that may be closed by one or more covers 42. It will also be understood that a door or the like (not shown) may be incorporated into the front wall 32 to permit access to the interior of the apparatus. The door may further include safety switch that disables operation of the apparatus unless the door is in a closed orientation. The base 28 is constructed of metal or a metal alloy, but may also be constructed of a plastic or other polymer having suitable strength characteristics. Likewise, the upper surface and walls are constructed of a plastic or other polymer having suitable strength characteristics. A plurality of legs 44 may extend from the base 28 to support the paper-folding apparatus 10 above a floor or tabletop (not shown). A foot 46 (or a wheel) may be positioned on each leg 44 to further support the paper-folding apparatus 10 (or permit the paper-folding apparatus 10 to be moved).

As will be discussed below, the hopper 12, discharge feed and stripper assembly 14, shuttle 16, conveyor 18 and the folding roller assembly 20 are disposed within the body 26. However, it will be appreciated that the principal purpose of the body 26 is that of a safety and support structure and that the actual shape and construction of the body 26 and the arrangement of the various above components thereon or therein may be modified according to the particular needs of a user.

Referring to FIGS. 1 and 2, the hopper 12 includes a base surface 48 (or floor or top plate); a pair of opposed longitudinally extending sidewalls 50, 52; a front wall 54; and a rear wall 56. The cover(s) 42 is attached by hinges (not shown) to the body 26 of the paper-folding apparatus 10 over the hopper 12 such that when the cover(s) 42 is in an open position a user has access to the hopper 12. Conversely, when the cover 42 is in a closed position, the hopper 12 is enclosed within the body 26.

A pair of clamps 58, 60 are positioned on exterior surfaces 62 of the front and rear walls 32, 34 of the body 26 proximate the hopper 12. A rod 64, 65 extends through each clamp 58, 60 and the front 32 or rear 34 wall and is secured to an exterior face 66, 67 of one of the sidewalls 50, 52 of the hopper 12. Accordingly, each sidewall 50, 52 of the hopper 12 is independently transversely moveable in a reciprocal path, such that the hopper 12 can accommodate paper(s) of various widths. Additionally, a pair of tracks 68 (or grooves) is provided in the base 48 of the hopper. The tracks 68 are engaged by and support the rear wall 56 and permit movement of the rear wall 56 in a reciprocal path along the tracks 68. One or more clamps 70 may be provided on the rear wall 56, such that the rear wall 56 may be locked in a predetermined position so that the hopper 12 may accommodate paper(s) of various lengths.

A sensor 72 may be provided in the base 48 of the hopper 12 to indicate the presence of foldable media in the hopper (e.g., in a stack of paper) as a sheet is transmitted from the hopper 12 and to indicate when the hopper 12 is out of paper. The sensor 72 is preferably a photocell. However, other types of sensors or combination of sensors (to, for example facilitate the counting of sheets of paper) including a proximity sensor(s), laser or microswitches may also be used.

Referring now to FIGS. 1-3, and as best shown in FIG. 1, the shuttle 16 includes a body 74 having an upper surface 76, lower surface 78, and sidewalls 80, 82. The body 74 of the shuttle 16 also defines a hollow interior chamber 84 for the shuttle. The upper surface 76 is positioned in the hopper 12 planar to the base 48 and defines a plurality of apertures 86 that communicate with the interior chamber 84. A front face 88 (or leading edge) of the shuttle 16 includes a recessed portion 90. As will be discussed below, the recessed portion 90 of the shuttle 16 is operable to cooperate with the discharge feed and stripper assembly 14 to extract a sheet of paper from the hopper 12. The shuttle 16 is operable to move in a reciprocal path between a first location, where the shuttle 16 engages a sheet of paper, and a second location, where the engaged sheet of paper is transferred to the discharge feed and stripper assembly 14.

As best shown in FIG. 2, a vacuum pump 92 is positioned within the body 26 of the paper-folding apparatus 10 and is pneumatically connected by a line 93, hose, a tube or the like (not shown) to the lower surface 78 of the shuttle body 74. A valve 95 and pressure gauge 97 maybe positioned in the line between the pump 92 and the shuttle body 74 as a means of controlling and monitoring pressure in the line 93. The vacuum pump 92 operates to create a vacuum within the interior chamber 84 of the hopper 12 that generates suction through the apertures 86 of the shuttle body 74 when the shuttle body 74 is in the first position. The suction generated by the vacuum functions to draw a sheet of paper from a bottom of a stack paper positioned in the hopper 12 and onto the upper surface 76 of the shuttle body 74. Once the sheet of paper has been drawn onto the shuttle 16 by the action of the suction, the shuttle 16 is advanced to the second position. The movement of the shuttle 16 into a second position, proximate the stripper assembly 14, functions to disengage the suction and permit the sheet of paper on the shuttle to be released such that it may be transmitted into the discharge feed and stripper assembly 14.

Referring now to FIGS. 1, 2A and 2B, the discharge feed and stripper 14 assembly includes a first (or upper) roller 94 and a second (or lower) roller 96 positioned proximate the front wall 54 of the hopper 12; the axis of each roller 94, 96 being arranged perpendicular to the longitudinal axis of the body 26 of the paper-folding apparatus 10. As best shown in FIG. 2, the first 94 and second 96 rollers are positioned one over the other. An exterior surface of each roller 98, 100 engages the exterior surface of the opposite roller such that the rollers 94, 96 are driven in a counter-rotation to one other and create a drive path therebetween suitable for driving a sheet of paper. The lower roller 96 is preferably held in a fixed position relative to the body 26 of paper-folding apparatus 10. The upper roller 94 is moveable in the vertical plane, but is preferably locked into position prior to operation of the apparatus 10 by a use of biasing spring arrangement 102 that includes a locking clamp. It will be appreciated that the rollers 94, 96 may be arranged in other orientations and configurations suitable for driving a sheet of paper along a predetermined path. For example, the upper roller 94 may be made free-floating such that it is movable in the vertical direction during operation of the apparatus 10.

Referring now to FIG. 1, the length of at least the lower roller 96 of the discharge feed and stripper assembly 14 is less than the inside length of the recessed portion 90 of the shuttle 16. Therefore, when the shuttle 16 is in the second position, a sheet of paper on the upper surface 76 of the shuttle 16 is engaged by at least the lower roller 96 of the discharge feed and stripper assembly 14. Once engaged, the paper is transferred between the rollers 94, 96 and onto the conveyor 18.

One or more sensors 104 may be provided proximate the area of discharge of a sheet of paper in the discharge feed and stripper assembly 14 and is operable to monitor the number of sheets of paper that have been transferred to the conveyor 18. The sensor 104 is preferably a photocell. However, other types of sensors or combination of sensors including a proximity sensor(s), laser or microswitches may also be used. Accordingly, it will be appreciated that the discharge feed and stripper assembly 14 may be programmed by the control panel 24 to transmit one sheet of paper or, alternatively, several sheets of paper (to thereby form a stack of paper) onto the conveyor 18. For example, the shuttle 16 and the discharge feed and stripper assembly 14 may cooperate to create a stack of six sheets of paper on the conveyor 18, one sheet at a time.

Still referring to FIGS. 1, 2A and 2B, the conveyor 18 is preferably a belt conveyor that includes a first conveyor drum 106 and a second conveyor drum 108 that are displaced from each other and a belt 110 that runs a continuous path between the first and second conveyor drum 106, 108. However, other types conveyors (e.g., rollers) may also be used.

A ball transfer assembly 112 is positioned over the belt 110 of the conveyor to assist with maintaining the paper(s) on the belt 110 in contact with the belt 110. As best shown in FIG. 2, the ball transfer assembly 112 includes a housing 114 having an upper surface 116 and a lower surface 118. The lower surface 118 of the housing 114 includes a plurality of recesses 116. A ball 120, sphere or the like, is rotatably disposed in each recess 116 and is operable to engage (ride along) or otherwise be driven by the movement of the belt 110. The housing 114 of the ball transfer assembly 112 is supported above the conveyor 18 by a pair of transversely extending rods 122 that are secured to interior surfaces 124, 125 of the front 32 and rear wall 34 of the body 26 of the paper-folding apparatus 10.

Still referring to FIGS. 1, 2A and 2B, a paper guide 126 is provided at a front 128 (or paper-receiving portion) of the conveyor 18 proximate the first conveyor drum 106. The paper guide 126 has a forward portion 130 that is angled with respect to the plane of the conveyor belt 110 and a rear portion 132 that is parallel to the belt 110. Accordingly, as a sheet of paper is transmitted onto the conveyor 18 from the discharge feed and stripper assembly 14, it is deflected onto the belt 110 by the angled forward portion 130 of the paper guide 126. Then, as described above, the ball transfer assembly 112 operates to maintain the paper(s) in contact with the belt 110 as the paper(s) are transmitted to the folding roller assembly 20.

Referring to FIGS. 2A and 2B, indexing tools 131 are positioned on opposing ends of the belt 110. As shown, the indexing tools 131 are lugs that travel on the belt 110 and function to index the foldable media as it is deposited on the belt 110 by the operation of the discharge feed and stripper assembly 14. As an alternative to lugs, it will be appreciated that the indexing tool 131 may also include one or more solenoid positioned at one or both ends of the conveyor 16. The solenoid would be in communication with the control panel 24 and/or the conveyor clutch 178 such that it/they operate to selective extend fingers to engage and index foldable media on the belt 110 of the conveyor 16.

As shown in FIG. 2, one or more sensors 134 may be provided on the paper guide 126 proximate the front 126 of the conveyor. The sensor(s) 134 are operable to monitor the number of sheets of paper that have been transferred onto the conveyor 18. The sensor(s) 134 are preferably photocell(s). However, other types of sensors or combination of sensors including a proximity sensor(s), laser or microswitches may also be used.

Referring now to FIGS. 1 and 2, the folding roller assembly 20 includes an upper 136 and a lower 138 folding unit. The folding roller assembly 20 further includes an idler gear 140 that is operable to engage the second roller 144 such that the second roller rotates in a clockwise orientation to pull foldable media (or a stack thereof) on the conveyor 18 into the folding roller assembly 20. (turns 144 clockwise to pull paper in. Preferably, the idler gear 140 engages and is driven by the second drum 108, or alternatively, a gear disposed on the support axial 163 of the conveyor 18. For example, arrangements of gears (including the idler gear 140) may be positioned in a gear housing 165 that is operable to mechanically transmit power from the conveyor 18 (and/or the drive assembly 22) to the folding roller assembly 20. The first 142, second 144, third 146 and fourth 148 guide rollers also engage each other (as is known in the art) to create a path to drive the paper(s) as described. As best shown in FIG. 2, the idler gear 140 and second 144 guide wheel are fixed relative to the body 26 of the paper-folding apparatus 10 while the first 142, third 146 and fourth 148 guide wheels are self-adjusting in that the rollers 142, 146 and 148 are movably supported by and biased into position by spring biasing elements 150, 152 and 154.

As shown in FIG. 1, each roller has one or more gears or sprockets on an end as a means of being rotatably powered (as will be described below). Each roller 142, 144, 146, 148 also may be supported in the assembly on a stub shaft 161 positioned at each end of the roller 142, 144, 146, 148. The stub shafts 161 are removably securable in grooves (not shown) in the housing by setscrews. Accordingly, it will be appreciated that the rollers 142, 144, 146, 148 of the folder roller assembly 20 may be easily removed, cleaned and/or replaced by the user. Alternatively, each roller 142, 144, 146, 148 also may be supported in the folding roller assembly 20 by conventional shafts that extend longitudinally through the entire length of the roller 142, 144, 146, 148.

Upon ejection from the folding roller assembly 20, the folded paper(s) are collected in a collection unit 156. As shown, the collection area 156 is a panel. However, a bucket or basket may also be used as the collection area 156. Additionally, the collection area 156 may take the form of a second apparatus such as an envelope stuffing device, an envelope sealer, collator or the like.

As shown in FIG. 2, one or more sensor(s) 158 may be provided on the collection panel 156 to monitor the number of sheets of folded items that have been deposited onto the panel. The sensor 158 is preferably a photocell. However, other types of sensors or combination of sensors including a proximity sensor(s), laser or microswitches may also be used.

Referring now to FIGS. 1, 2A, 2B and 3 the drive assembly 22 includes a motor 162 having a first 164, a second 166 and a third 168 driven wheel. The motor 160 is preferably an electric motor. More preferably still, the motor is an 115v AC variable speed electric motor. A first drive belt 170 engages the first drive wheel 164 and is operable to continuously drive the lower roller 96 of the discharge feed and stripper assembly 14. However, it will be appreciated that a clutch (not shown), or other arrangement, may be placed intermediate to the first driven wheel 164 and the lower roller 96 such that the rotation of the lower roller 96 may be selectively controlled, independent of the motor 160.

A shuttle clutch 170 and shuttle drive wheel 172 are provided proximate the motor 160 and driven by a first 174 and second 176 drive belts. As shown in FIG. 2, the first drive belt 174 extends from the second driven 166 wheel and engages the shuttle clutch assembly 170. The second drive belt 176 extends from the shuttle clutch assembly 170 to drive the shuttle drive wheel 172. A mechanical linkage (as is known in the art) extends from the shuttle drive wheel 172 to actuate the shuttle.

The drive assembly 22 further includes a conveyor clutch assembly 178 and a fourth 180 and fifth 182 drive belt (or chain). Preferably, the fourth drive belt 180 extends from the third driven wheel 168 to the conveyor clutch assembly 178. The fifth drive belt 182 (or chain) extends from the conveyor clutch assembly 178 to the second conveyor drum 108 to thereby drive the second drum 108, and thus the conveyor belt 110. It will be appreciated that the diameters of the conveyor clutch assembly 178 and/or the second drum 108 may be modified according to the needs of the use to ensure proper timing of the belt 110 and thus proper indexing of foldable media with the indexing tool 131. It will also be appreciated that the timing may be adjusted to ensure proper timing of the sprocket 140 and thus proper transfer of foldable media from the conveyor 16 and onto the folding roller assembly 20.

Figure 4:
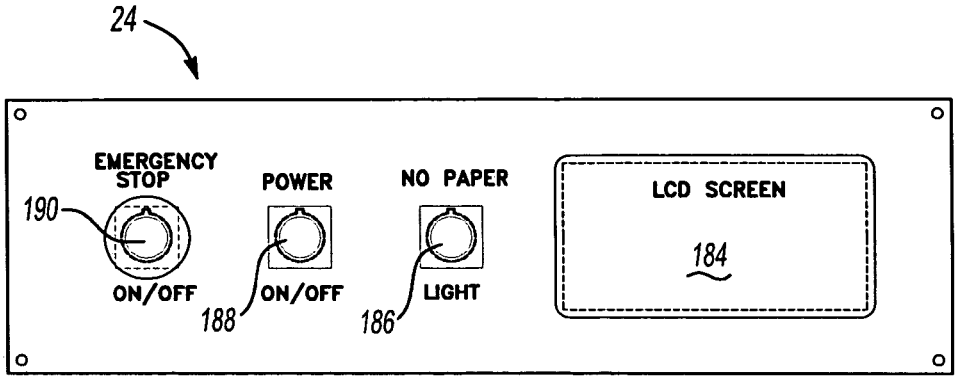
FIG. 4 is a control panel for use in connection with the folding apparatus of the present invention.

Referring now to FIG. 4, there is shown a control panel 24 for use in connection with the operation of the apparatus of the present invention. The control panel 24 includes an LCD screen 184 that communicates with software in the paper-folding apparatus 10 and permits a user to input operation commands into the paper-folding apparatus 10. The software is preferably PLC (programmable logic controller) software that is known in the art. The control panel 24 may also include a light 186, or other visual indicator, that the hopper 12 is out of paper, a power on/off button 188 and an emergency stop button 190.

The use of a shuttle clutch assembly 170 and a conveyor clutch assembly 178 allows independent operation of the hopper 12, conveyor 18, and folding assemblies 20 using, preferably, a single motor 162. As such, the paper-folding apparatus 10 disclosed herein offers a particular advantage over prior art devices that use a plurality of motors or in-servo motors to actuate various functions of a machine or that continuously drive all the components of the machine. The use of clutches also permits the present paper-folding apparatus 10 to be manufactured in a compact form relative to the prior art. Finally, the cooperation of the shuttle 16, discharge feed and stripper assembly 14, and conveyor 18 as controlled by the control panel 24 and the drive assembly 22, permit a user to create sub-stacks of papers on the conveyor 18 and thereby fold either a stack of paper, or just one sheet, according to the needs of a user.

While the present invention has been described as being carried out in a specific embodiment, it is not intended to be limited thereby, but is intended to cover the invention broadly within the scope and spirit of the appended claims.

The invention claimed is:

1. A paper-folding apparatus operable to fold one or more sheets of a foldable media at a time comprises:

a hopper operable to hold a sheet of foldable media;

a shuttle associated with the hopper movable between a first position and a second position and being operable to engage the sheet of foldable media in the hopper when in the first position and release the sheet of foldable media when in the second position;

a discharge feed and stripper assembly operable to receive and advance the sheet of foldable media from the shuttle;

a conveyor operable to receive and advance the sheet of foldable media from the discharge feed and stripper assembly;

a folding roller assembly operable to receive the sheet of foldable media from the conveyor and fold and advance the sheet of foldable media;

a drive assembly including a single motor, the single motor being operable to drive the shuttle, the discharge feed and stripper assembly, the conveyor, and the folding roller assembly; and a housing, the hopper, the shuttle, the discharge feed and stripper assembly, the conveyor, the folding roller assembly and the drive assembly being positioned within the housing.

2. The paper-folding apparatus of claim 1, wherein the drive assembly includes a shuttle clutch operable to selectively actuate the shuttle.

3. The paper-folding apparatus of claim 1, wherein the drive assembly includes a conveyor clutch operable to selectively actuate the conveyor.

4. The paper-folding apparatus of claim 1, wherein the shuttle includes a body, the body defining an interior chamber and having an upper surface, a lower surface and a front face, the upper surface defining a plurality of apertures that communicate with the hollow interior.

5. The paper-folding apparatus of claim 4 further comprising a vacuum pump pneumatically connected to the body of the shuttle and being operable to create a vacuum within the interior chamber, the vacuum generating a suction through the apertures to draw a sheet of foldable media paper from the hopper onto the upper surface of the shuttle body when the shuttle is in the first position.

6. The paper-folding apparatus of claim 4, wherein the front face of the shuttle includes a recessed portion.

7. The paper-folding apparatus of claim 6, wherein the discharge feed and stripper assembly includes a first roller and a second roller positioned proximate the hopper.

8. The paper-folding apparatus of claim 7, wherein the front face of the shuttle includes a recessed portion having a length that is greater than the length of the second roller such that at least a portion of the second roller is positioned within the recessed portion when the shuttle is in the second position.

9. The paper-folding apparatus of claim 1, wherein the discharge feed and stripper assembly includes a first roller and a second roller positioned proximate the hopper.

10. The paper-folding apparatus of claim 1, wherein the conveyor further comprises an indexing tool.

11. The paper-folding apparatus of claim 1, further comprising a ball transfer assembly operable to engage the conveyor to maintain the foldable media in contact with the conveyor.

12. The paper-folding apparatus of claim 1, wherein the hopper includes a base surface, a pair of movable opposed sidewalls, a front wall and a movable rear wall.

13. The paper-folding apparatus of claim 1, wherein the folding roller assembly includes an upper folding unit and a lower folding unit.

14. The paper-folding apparatus of claim 1, wherein the folding roller assembly further comprises a collection unit.

15. The paper-folding apparatus of claim 1, wherein the folding roller assembly further comprises a self-adjusting roller.

16. The paper-folding apparatus of claim 1, wherein the folding roller assembly further comprises a gear assembly in communication with the conveyor such that operation of the conveyor drives the folding roller assembly.

17. A paper-folding apparatus operable to fold one or more sheets of a foldable media at a time comprises:

a hopper operable to hold a sheet of foldable media;

a shuttle associated with the hopper movable between a first position and a second position and being operable to engage the sheet of foldable media in the hopper while in the first position and release the sheet of foldable media when in the second position;

a discharge feed and stripper assembly operable to receive and advance the sheet of foldable media from the shuttle;

a conveyor operable to receive and advance the sheet of foldable media from the discharge feed and stripper assembly;

a folding roller assembly operable to receive the sheet of foldable media from the conveyor and fold and advance the sheet of foldable media;

a drive assembly operable to drive the shuttle, the discharge feed and stripper assembly, the conveyor and the folding roller assembly, the drive assembly consisting of a motor, a shuttle clutch and a conveyor clutch, the shuttle clutch being driven by the motor and being operable to selectively actuate the shuttle, the conveyor clutch being driven by the motor and being operable to selectively actuate the conveyor; and a housing, the hopper, the shuttle, the discharge feed and stripper assembly, the conveyor, the folding roller assembly and the drive assembly being positioned within the housing.

18. The paper-folding apparatus of claim 17 wherein the shuttle further comprises a body, the body defining an interior chamber and having an upper surface, a lower surface and a front face, the upper surface defining a plurality of apertures that communicate with the hollow interior.

19. The paper-folding apparatus of claim 17, further comprising a vacuum pump pneumatically connected to body of the shuttle and being operable to create a vacuum within the interior chamber, the vacuum generating a suction through the apertures to draw a sheet of foldable media paper from hopper onto the upper surface of the shuttle body when the shuttle is in the first position.

20. The paper-folding apparatus of claim 17, wherein the discharge feed and stripper assembly further comprises a first roller and a second roller positioned proximate the hopper.

21. The paper-folding apparatus of claim 17, wherein the conveyor further comprises an indexing tool.

22. The paper-folding apparatus of claim 17, further comprising a ball transfer assembly operable to engage the conveyor to maintain the foldable media in contact with the conveyor.

23. The paper-folding apparatus of claim 17, wherein the folding roller assembly further comprises an upper folding unit and a lower folding unit.

24. The paper-folding apparatus of claim 17, wherein the folding roller assembly further comprises a collection unit.

25. A paper-folding apparatus operable to fold one or more sheets of a foldable media at a time comprises:

a hopper operable to hold a sheet of foldable media;

a shuttle associated with the hopper movable between a first position and a second position and being operable to engage the sheet of foldable media in the hopper while in the first position and release the sheet of foldable media when in the second position;

a discharge feed and stripper assembly including an first roller and a second roller, the first and second roller being operable to receive and advance the sheet of foldable media from the shuttle;

a conveyor operable to receive and advance the sheet of foldable media from the discharge feed and stripper assembly;

a folding roller assembly operable to receive the sheet of foldable media from the conveyor and fold and advance the sheet of foldable media;

a drive assembly operable to drive the shuttle, the discharge feed and stripper assembly, the conveyor and the folding roller assembly, the drive assembly consisting of a motor, a shuttle clutch and a conveyor clutch, the motor be operable to continuously drive the second roller of the discharge feed and stripper assembly, the shuttle clutch being driven by the motor and being operable to selectively actuate the shuttle, the conveyor clutch being driven by the motor and being operable to selectively actuate the conveyor; and a housing, the hopper, the shuttle, the discharge feed and stripper assembly, the conveyor, the folding roller assembly and the drive assembly being positioned within the housing.

* * * * *

UNITED STATES PATENT AND TRADEMARK OFFICE

CERTIFICATE OF CORRECTION

PATENT NO. : 7,303,523 B2
APPLICATION NO. : 10/924610
DATED : December 4, 2007
INVENTOR(S) : Ceasar P. Andolfi It is certified that error appears in the above-identified patent and that said Letters Patent is hereby corrected as shown below:

Column 2, Line 22, replace “planar of” with --planar view of--

Column 4, Line 29, replace “one other” with --one another--

Column 5, Line 4, replace “types conveyors” with --types of conveyors--

Column 5, Line 43, replace “selective extend” with --selectively extend--

Column 5, Line 60, replace “paper in.” with --paper in.)--

Column 10, Line 11, replace “an first” with --a first--

Column 10, Line 25, replace “be operable” with --being operable--

Signed and Sealed this

Sixth Day of May, 2008

JON W. DUDAS
*Director of the United States Patent and Trademark Office*